US007909169B1

(12) United States Patent
Slade

(10) Patent No.: US 7,909,169 B1
(45) Date of Patent: Mar. 22, 2011

(54) METHODS AND SYSTEMS FOR RECOVERING ALLUVIAL GOLD

(76) Inventor: James Edward Slade, Calgary (CA)

( * ) Notice: Subject to any disclaimer, the term of this patent is extended or adjusted under 35 U.S.C. 154(b) by 81 days.

(21) Appl. No.: 12/203,085

(22) Filed: Sep. 2, 2008

Related U.S. Application Data

(60) Provisional application No. 60/969,597, filed on Aug. 31, 2007.

(51) Int. Cl.
*B03B 7/00* (2006.01)

(52) U.S. Cl. ..... 209/44; 209/14; 209/40; 209/562

(58) Field of Classification Search ..... 209/19, 209/40, 44, 562
See application file for complete search history.

(56) References Cited

U.S. PATENT DOCUMENTS

| | | | | |
|---|---|---|---|---|
| 3,888,351 | A * | 6/1975 | Wilson | 209/557 |
| 4,265,743 | A * | 5/1981 | Younge | 209/452 |
| 4,347,130 | A * | 8/1982 | Younge | 209/452 |
| 5,314,124 | A * | 5/1994 | Kindig | 241/20 |
| 5,568,896 | A * | 10/1996 | Adams et al. | 241/24.29 |
| 6,096,991 | A * | 8/2000 | Stone et al. | 209/589 |
| 6,216,367 | B1 * | 4/2001 | Tubbs | 37/314 |
| 2007/0278139 | A1 * | 12/2007 | Cowling et al. | 209/606 |

OTHER PUBLICATIONS

Haver & Boecker, The Screening Circle, HBL-TYCAN 020 E—Revised Jul. 2005, pp. 1-19, St. Catharines, Canada.

James Slade, Update on Steinert ISS 160 for Placer Mining, Memo—ISS Report, Apr. 2, 2008, pp. 1-6, AuVERT Gold Systems Inc., Langley, Canada.

D.E. Walsh, Eddy-Current Separator Technology As a Novel Approach to Alaskan Placer Gold Recovery, 2003 SME Annual Meeting, Feb. 24-26, 2003, pp. 1-5, Cincinnati, USA.

Knelson, Semi-Continuous Knelson Concentrators, Jun. 2005, Knelson, Langley, Canada.

Knelson, Continuous Variable Discharge Knelson Concentrator, Knelson, Langley, Canada.

Constep, The Consep Acacia Reactor, ConSep, Wetherill Park, Australia.

Steinert, Induction Sorting System, pp. 1-4, Steinert, Widdersdorfer Straβe, Germany.

Eriez, Eddy Current Separators Principle and Practice, Eriez Magnetics Europe Limited, Bedwas, United Kingdom.

L-Class Vibrating Screens—Level (Horizontal) Vibrating Screens, TYCAN—Vibrating Screen Division of W. S. Tyler Canada Ltd, St. Catharines, Canada.

James Varela, HAVER Hydro-Clean, Jul. 9-11, 2008, pp. 1-40, Haver & Boecker, Santiago, Chile.

* cited by examiner

*Primary Examiner* — Terrell H Matthews
(74) *Attorney, Agent, or Firm* — DWC Law Firm, P.S.; David Chen

(57) ABSTRACT

Various embodiments of methods and systems are provided for mining alluvial gold deposits. The methods can comprise collecting feed from alluvium and washing the feed at high pressure. The feed can be separated into a plurality of separate fractions. At least one fraction is transferred to a metal sensor system using a conveyer, wherein when gold is detected in a piece of the fraction, an air blast can be targeted and delivered at the piece, with the air blast diverting the piece to a receiving container.

16 Claims, 4 Drawing Sheets

CLASSIFICATION SIEVE ANALYSIS ASTM C-136 OR D-422

PERCENT MOISTURE OF FINES: 6.5%

SAMPLE DESCRIPTION: Well-Grated GRAVEL w/ Sand and Cobbles (GW)

| SCREEN SIZE | ACC. WT. RETAINED | RECENT RETAINED | RECENT PASSING | FRACTURE COUNT | **TOTAL PERCENT** | |
|---|---|---|---|---|---|---|
| 6" | 0 | 0 | 100% | | **100%** | |
| 4" | 7.93 | 4% | 96% | | **96%** | |
| 3" | 11.48 | 6% | 94% | | **94%** | |
| 2 1 / 2" | 25.89 | 13% | 87% | | **87%** | |
| 2" | 40.12 | 20% | 80% | | **80%** | |
| 1 1 /2" | 57.84 | 28% | 72% | | **72%** | |
| 1" | 84.05 | 41% | 59% | | **59%** | |
| 3 / 4" | 99.24 | 49% | 51% | | **51%** | |
| 3 / 8" | 131.30 | 64.3% | 35.7% | | **35.7%** | |
| | | | | | | |
| Total | 204.05 | | | | | |
| SIEVE | ACC. WT. RETAINED | PERCENT RETAINED | PERCENT PASSING | X-FACTOR | | |
| #4 | 475.2 | 22% | 78% | 0.357 | **28%** | |
| #8 | 848.9 | 40% | 60% | 0.357 | **22%** | |
| #16 | 1132.5 | 53% | 47% | 0.357 | **17%** | |
| #30 | 1380.8 | 64% | 36% | 0.357 | **13%** | |
| #50 | 1671.8 | 78% | 22% | 0.357 | **8%** | |
| #100 | 1820.9 | 85% | 15% | 0.357 | **5%** | |
| #200 | 1875.7 | 87.5% | 12.5% | 0.357 | **4.4%** | |
| | | | | | | |
| Total | 2142.5 | | | | | |

| | | | |
|---|---|---|---|
| | | PAN I.D & WGT…: 1 | 356.4 |
| WGT.OF PAN SAMPLE: | 77.49 | WGT. PAN & WET SOIL | 2638.4 |
| WGT. OF PAM SAMPLE – MOISTURE: | 72.75 | WGT. PAM & DRY SOIL | 2498.9 |

*FIG. 4*

METHODS AND SYSTEMS FOR RECOVERING ALLUVIAL GOLD

CROSS-REFERENCE TO RELATED APPLICATION(S)

This application claims the benefit of U.S. provisional patent application Ser. No. 60/969,597, filed Aug. 31, 2007, which is incorporated herein by reference in its entirety.

BACKGROUND

1. Field of the Invention

The present invention relates generally to a method and system of recovering gold from alluvial placer deposits.

2. Description of Related Art

Placer gold mining historically relied upon a sluice box, and its variants, to separate the gold from the gravel matrix. The sluice has been the primary method of gold recovery from its historical introduction to the present.

A typical alluvial mining plant uses a very large volume of water to transport the larger size gravels over the recovery sluice. Depending on volume being processed, water usage can be over 5000 gallons per minute. The percentage recovery of gold in a typical sluice box is 20% to 40% of all gold run through it. This low recovery percentage is even be lower when the gold is still attached to the host rock, such as in matrix pieces. Matrix pieces usually comprise quartz with a small percentage of gold, are lower in specific gravity than pure gold nuggets and are thus commonly washed out of a sluice recovery system. Because there has been no efficient way to recover this percentage of gold in the past, the lost revenue to the operator is significant. Many placer companies find it difficult to financially survive, even in rich areas, when their recovery is so low.

The process of a sluice recovery system is not environmentally friendly. The large volume of water required creates obstacles in sourcing and cleaning the water of solids before returning to the source. This typically involves using large settling ponds, which implicates corresponding costs of land use, construction costs, excess fuel burning during construction and final reclamation. In addition, the pumping and dewatering of such large volumes of water requires significant power.

BRIEF SUMMARY OF THE INVENTION

Various embodiments of methods and systems are provided for mining alluvial gold deposits. The methods can comprise collecting feed from alluvium and washing the feed at high pressure. The feed can be separated into a plurality of separate fractions, each fraction containing solids having a different range of diameters from the solids of at least one other fraction. The ranges of diameters for solids, each in a different fraction, can be 0-3 mm, 3-50 mm, and 50-150 mm.

The 0-3 mm fraction contains gold that can be separated from other components in the fraction in a centrifugal concentrator. The 50-150 mm fraction can be fed to a conveyer, and a metal detector is positioned proximate the conveyer to detect gold. When gold is detected, a feed chute positioned proximate and below an end of the conveyer is redirected to guide gold dropping from the conveyer to a receiving container. The 3-50 mm fraction is also transferred to a metal detection system using a conveyer, wherein when gold is detected in a piece of the fraction, an air blast is targeted and delivered at the piece. The air blast diverts the piece to a receiving container.

BRIEF DESCRIPTION OF THE DRAWINGS

FIG. 4 is an example size fraction chart for head feed.

DETAILED DESCRIPTION OF PREFERRED EMBODIMENTS

In the following description, certain specific details are set forth in order to provide a thorough understanding of various embodiments of the invention. However, upon reviewing this disclosure, one skilled in the art will understand that the invention may be practiced without many of these details. In other instances, some well-known structures and methods associated with screening equipment, mining plant control systems and hardware, and various mechanical components have not been described in detail to avoid unnecessarily obscuring the descriptions of the embodiments of the invention.

Figure 1:
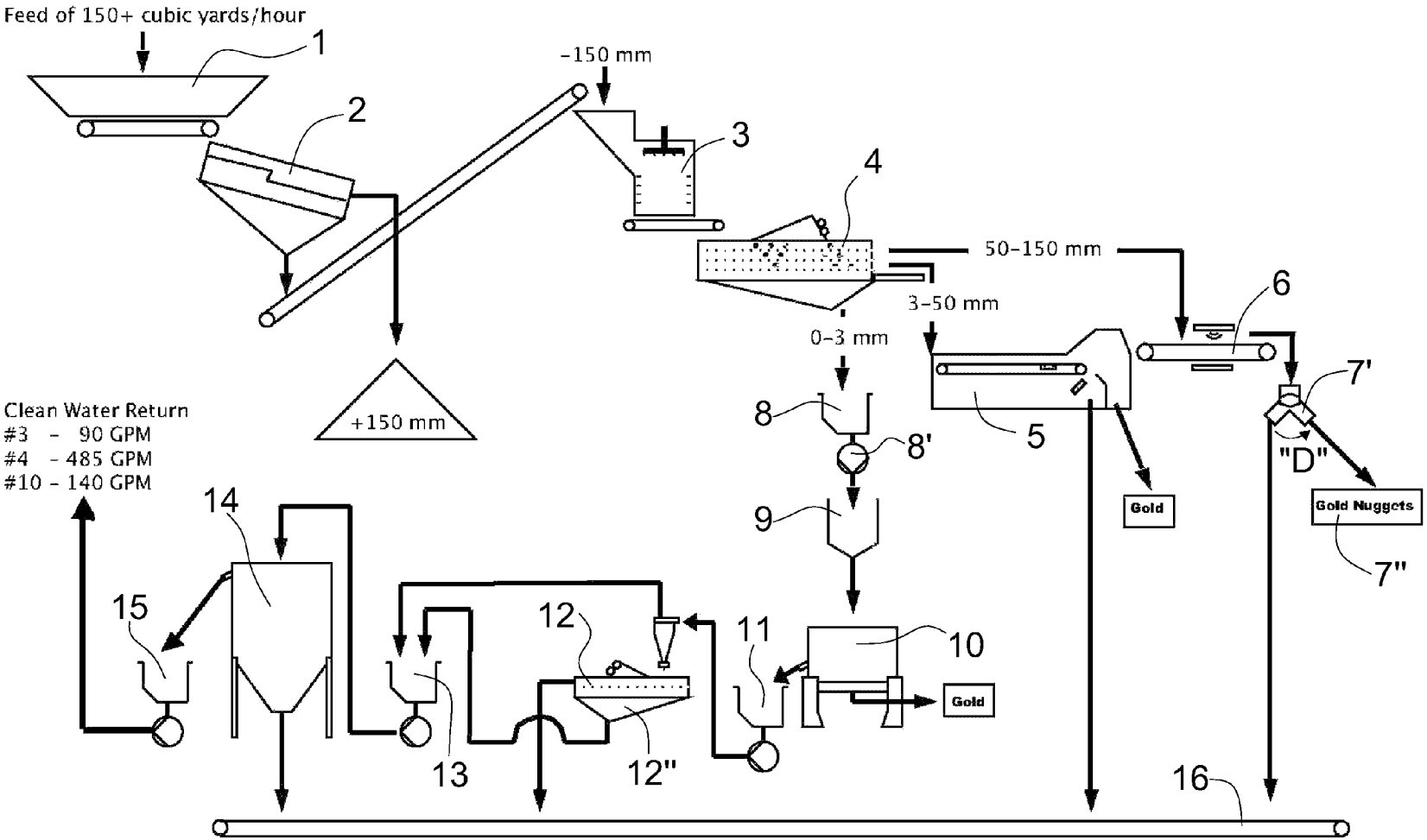
FIG. 1 is a simplified process diagram for an embodiment of the present invention.

Referring to FIG. 1, ore collected from alluvium is loaded into the plant at a variable speed feed hopper 1. The ore can be loaded by an excavator, or a wheeled loader. In some embodiments, the capacity of the plant can be varied, while the size fractions and water flow are the same.

The variable speed feed hopper 1 (which can be, for example, the commercially available TYCAN X-260, manufactured by W.S. TYLER) feeds into a scalping screen 2 which can be a step-deck, four bearing screen (such as the TYCAN F-900 class manufactured by W.S. TYLER) for use in cleanly separating large rocks and boulders away from the feed. The screen media can be comprised of heavy steel panels with circular holes of 150 mm. In other embodiments of the present invention, the circular holes of the screen media can be less than 150 mm or more than 150 mm. The final size of the screen media holes selected for the system can depend on the size fraction analysis of the gravels and the gold to be recovered, as will be appreciated by those skilled in the art after reviewing this disclosure. For some example embodiments of the present invention provided herein, an example size fraction analysis for the head feed is shown in FIG. 4. Factors such as percentage of clay, caliche and the amount of large gold nuggets anticipated are also considered in size selection of the scalping screen. If testing has not indicated the potential for any large gold nuggets, then the size of the feed to the plant can be reduced by decreasing the size of the openings on the scalping screen.

The screened feed can be fed into a wash unit 3, as shown in FIG. 1. In some embodiments of the present invention, the wash unit 3 can be a commercially available HYDRO-CLEAN wash unit, manufactured by HAVER & BOECKER. Suitable models can include, without limitation, the model HC 1000/140, which operates with a water washing pressure of up to 140 bars (2030 psi) and a maximum material throughput of 185 tons/hr. In other embodiments, the maximum water pressure can be higher than 2030 psi, or lower than 2030 psi, and maximum material throughput can be higher or lower than 185 tons/hour (e.g. 400 tons/hr with a particle size of up to 150 mm). The washing unit 3 can be selected to exhibit low water and energy consumption, such as demonstrated by the HYDRO-CLEAN system referenced above.

Figure 2:
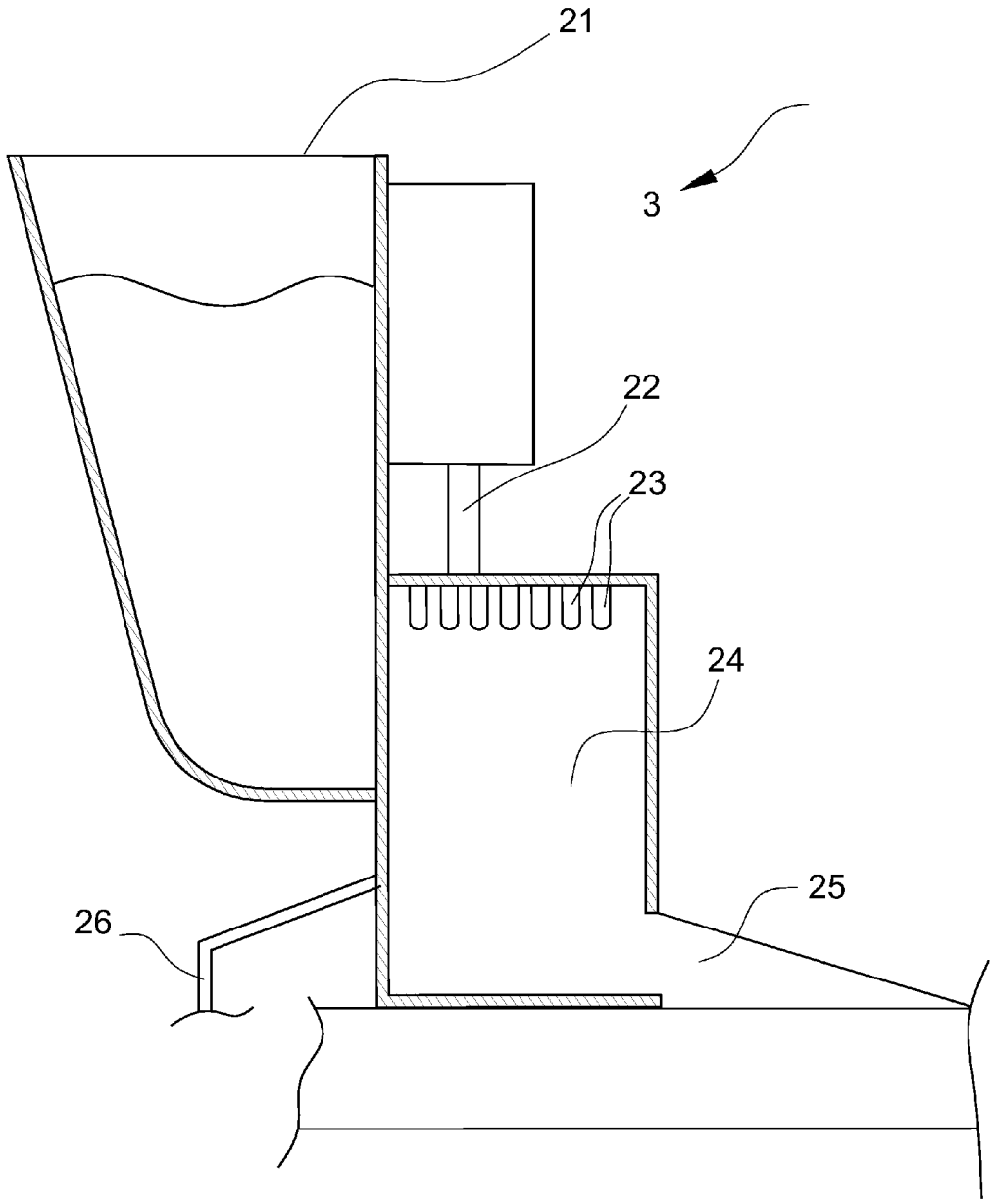
FIG. 2 is a simplified partial cross-sectional view of a washing unit used in some embodiments of the present invention.

Referring now to FIG. 2, at the washing unit 3, the feed (i.e., raw material) enters through a feed hopper 21. A level sensor (not illustrated) is provided on the feed hopper 21 to monitor feed level in the feed hopper. In some embodiments of the present invention, the level on the feed hopper is used to control the feed rate to the plant at variable speed feed hopper 1, through the use of a programmable control system. From the feed hopper 21, the feed passes into the washing chamber 24, where it is washed by water jets 23. The material transport section 25 moves the feed to the next step in the process at the horizontal deck screen 4. The high pressure jet wash provided by the water jets 23 in the wash unit 3 substantially dissolves all clay in the feed. Clay can trap fine gold particles if not fully liberated. The water pressure used in the washing unit 3 can be optimized based on the clay content of the feed material. Slower feed and higher pressure can handle a higher clay percentage in the ore.

Referring back to FIG. 1, the washed feed from the wash unit 3 is moved to a horizontal screen 4, such as, without limitation, the commercially available TYCAN L-CLASS horizontal screening system, which can be a three-deck screen. The use of a horizontal screen 4, versus an inclined screened, can minimize water loses to the oversize rock, such as, for example, by increasing screen retention time and reducing side wall runoff, as will be appreciated by those skilled in the art after reviewing this disclosure. Fine particles of gold can be carried through the screen to the gravity recovery system, starting at unit 8. Washed aggregate is separated into useable size fractions and rinsed of the clay. In some embodiments of the present invention, a water nozzle pattern for rinsing is selected to ensure overlap of the water spray on rock that passes through the water flow. This can help ensure that no fine gold stays attached to the larger rock fractions. The fractions can be, for example, (a) 0-3 mm, (b) 3-50 mm, and (c) 50-150 mm, as shown in FIG. 1. Substantially all water follows the 0-3 mm fraction except for a small amount lost due to wetting. The 0-3 mm fraction drains from the three-deck screen to the sump 8, as discussed further below.

The 3-50 mm fraction is fed directly onto a moving belt of a nugget recovery system 5. The interface between the screen deck and the nugget recovery system can be designed to eliminate spillage and ensure an even flow onto the recovery belt. The interface can include a chute with sidewalls and curtains to ensure all of the material is deposited onto the nugget recovery belt and not lost to spillage. This interface can provide for a compact footprint that allows easier moving of the plant, which can be required in concurrent placer mining methods. The elimination of additional motors, belts and feeders can make for a simpler plant design and less maintenance and operational costs.

Figure 3:
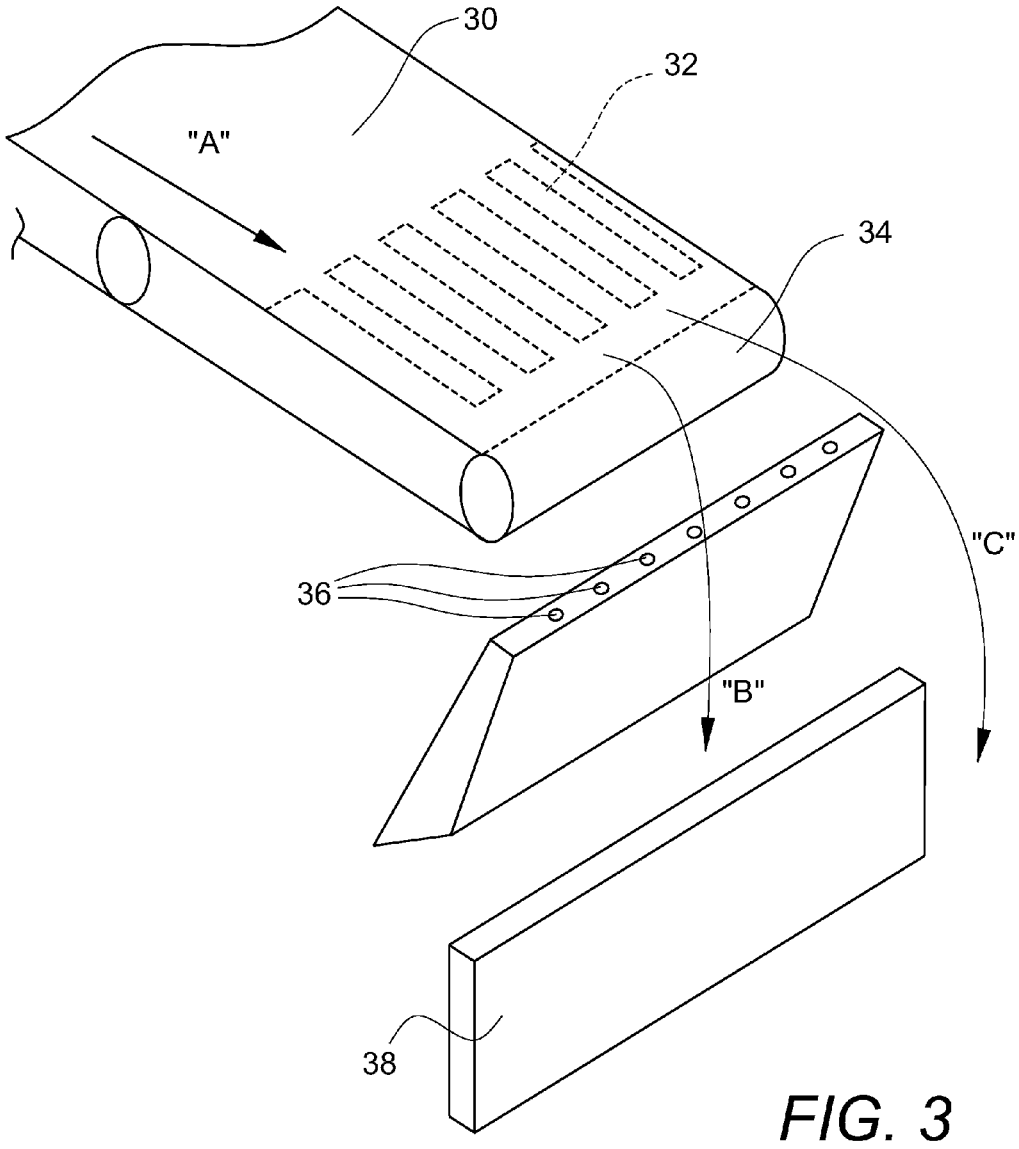
FIG. 3 is a simplified perspective diagram of the nugget recovery system for some embodiments of the present invention.

The components of the nugget recovery system 5 can be comprised of, for example, an INDUCTION SORTING SYSTEM ISS, which is commercially available from STEINERT ELEKTROMAGNETBAU GmbH company of Germany with offices at Widdersdorfer Straβe 329-331 50933 Köln/Germany. As best seen in FIG. 3, the nugget recovery system 5 can include a conveyer belt 30, with a bank of magnetic induction sensors 32 located beneath the conveyer belt 30, and/or optical sensors located above the belt, near an end portion 34 thereof. The sensors 32 analyze the fractional feed over the width of the conveyer belt 30. The conveyor belt can be upgraded from the commercially available units to handle heavy aggregate material and can have a security cover installed to cover the belt to help prevent theft of gold. As metal particles (e.g., the small gold bearing rocks) are detected by the sensors as they pass over them on the conveyer belt, a timed blast of compressed air can be released by one or more nozzles 36 positioned at the end of the conveyer belt 30. The blast of compressed air can redirect the identified particle from its original path while falling from an end of the conveyer belt 30, to a path over a diverter gate 38.

In some embodiments of the present invention, the angle of the blast nozzles are tuned to efficiently move the gold over the splitter (i.e. diverter gate 38) when combined with the appropriate amount of pressure in the air blast itself. The height for the top edge of the diverter gate 38 and distance from the conveyer can be adjusted to address specific characteristics of gold nuggets. The optimized pressure, angle, and diverter gate size and distance can help limit damage to collector grade gold nuggets while providing efficient or full recovery, as will be appreciated by those skilled in the art after reviewing this disclosure. Once over the diverter gate 28, gold bearing rocks are automatically carried by way of a chute into a secure, lockable container, or storage safe (not illustrated in the drawings) for safe storage until plant shut down. The level of security and the size of the storage safe are configured for the individual mine. Some locations will only remove the nuggets on an intermittent basis, others daily. The lock box can be designed to allow secure removal without revealing the contents.

In further embodiments of the present invention, such as large volume plants, for a process feed with high percentage of greater than 3 mm gold, a secondary nugget recovery step can be used on the collected fraction. That is, downstream of the nugget recovery system 5 (the primary nugget recovery system), the collected mixture holding gold can flow over to another, or secondary, nugget recovery system of smaller size, which would effectively eliminate the rocks and leave only the gold. This secondary nugget recovery system can be position in series with the primary nugget recovery system, and can be an eddy current recovery system. An example eddy current recovery system also is commercially available through STEINERT ELEKTROMAGNETBAU GmbH of Germany. In some embodiments, the eddy current system is suitable for a secondary recovery system, since the induced magnetic field of the gold nuggets can be more targeted to deflect finer particles of gold than the compressed air system for the primary nugget recovery system 5. In other embodiments of the present invention, a compressed air system is utilized for the secondary nugget recovery system, and can be an ISS unit produced by STEINERT that is smaller than the primary nugget recovery system. The non-gold bearing rocks can fall normally off the conveyor and are carried away to a stacking conveyor for reclamation, or sale as aggregate.

The 50-150 mm fraction can be automatically transported from the horizontal screen 4 onto a small cross conveyor 6. An industry standard metal detector such as made by ERIEZ MAGNETICS of Erie, Pa., is positioned to monitor the 50-150 fraction as it passes on the cross conveyor 6 and when metal is detected, a trip signal is sent to activate a reject gate 7 (described below). As such, substantially all nuggets and metallic objects greater than 50 mm that have passed through the wash plant will be detected and caught here at the cross conveyor 6.

Referring to FIG. 1, the reject gate 7 mounts to the head of the cross conveyor 6 and is activated by a signal from the metal detector (not illustrated) on the cross conveyor 6, as described above. When the reject gate 7 is activated, a feed chute 7' at the end of the cross conveyer 6 is rotated by ninety (90) degrees in the direction of arrow "D" to deposit the detected material into a secure storage container 7". The feed chute 7' then returns to normal position to allow aggregate to flow onto the waste conveyor 16. The cross conveyor on this system can have an upgraded belt cleaning device commercially available to ensure no contamination of the large material enters the secure storage bin. If the area being mined has significant tramp steel, such as old mine tailings sites, then a commercially available tramp steel magnet can be installed prior to the metal detector to eliminate false tripping.

The 0-3 mm fraction containing water drains into a sump 8 and the water from the sump 8 is pumped, with pump 8', up into a holding tank 9. The holding tank 9 holds the 0-3 mm material and water and feeds it by gravity to a gold concentrator 10 such as a KC-48CD manufactured by KNELSON CONCENTRATORS of Langley, B.C., Canada. The existence of the holding tank 9 can allow the gold concentrator 10 to run batch flush operations to flush itself as often as every hour, while at the same time, the upstream portion of the process continues to operate and the holding tank 9 builds level. The flushing operations of the gold concentrator 10 can be a few minutes in some embodiments of the present invention.

In some embodiments of the present invention, such as those used with ore bodies having high percentage of black sand (illmenite, rutile, magnetite, etc), the gold concentrator 10 can be a semi-continuous centrifugal concentrator, like the CVD-42 again made by KNELSON which recovers the fine gold through gravity separation at high gravity. The concentrator 10 can recover small particles of gold and flush them into a separate concentrate container.

Tailings from the concentrator 10 can be drained into sump 11 after gold removal. In some embodiments of the present invention, most of the water in the entire process ends up here in sump 11, and is pumped into a de-watering system 12, for removal of the clay and sand from the water.

The de-watering system combines an industry standard cyclone 12', such as, for example, the model GMAX15 manufactured by KREBS ENGINEERING in the USA, and feeding the underflow to a high frequency de-watering screen 12", such as, for example, the model TYCAN L Class manufactured by W.S. Tyler in the USA. The combination of the cyclone 12' and de-watering screen 12" can maximize water removal from the solids and deposit the sand onto the reclamation conveyor 16, as shown in FIG. 1. The cyclone overflow, plus the screen underflow can consist of water and fine clays. This material is collected in another sump 13 and associated pump for transfer to a water clarifier 14.

The water clarifier 14 can be an industry standard system designed to remove the clay and suspended solids from the water. An example suitable commercial embodiment includes the use of ULTRASEP THICKENERS manufactured by WES-TECH ENGINEERING of Salt Lake City, Utah, USA. Polymer flocculants can be used to allow a discharge of mud onto the reclamation conveyor. The water overflow can be sufficiently clean to be returned to the plant with little loss. The majority of the water lost in the process is can be attributed to gravel wetting and evaporation.

Clean water is collected and returned to the system at sump/clean water tank 15 and an associated pump. Water lost to the process can also be added at this location to control water level in the clean water tank 15.

The process and system recited above can reduce water consumption when compared with traditional mining systems and methods for alluvial gold deposits and significantly increase gold recovery efficiency.

Although specific embodiments and examples of the invention have been described supra for illustrative purposes, various equivalent modifications can be made without departing from the spirit and scope of the invention, as will be recognized by those skilled in the relevant art after reviewing the present disclosure. The various embodiments described can be combined to provide further embodiments. The described systems and methods can omit some elements or acts, can add other elements or acts, or can combine the elements or execute the acts in a different order than that illustrated, to achieve various advantages of the invention. These and other changes can be made to the invention in light of the above detailed description.

What is claimed is:

1. A method of mining alluvial gold deposits, comprising:
collecting feed from alluvium;
washing the feed at high pressure;
separating the feed into a plurality of separate fractions, each fraction containing solids having a different range of diameters from the solids of at least one other fraction;
passing at least one of the fractions over a sensor for detecting gold, wherein when gold is detected in a piece of the fraction, an air blast is targeted and delivered at the piece; and
wherein at least one of the fractions contains gold that is detected on a conveyer using a metal detector, and wherein after the gold in the at least one of the fractions is detected, a feed chute positioned proximate an end of the conveyer is redirected to guide gold from the conveyer to a receiving container.

2. The method of claim 1 wherein the range of diameters in at least one of the fractions is approximately 0-3 mm.

3. The method of claim 1 wherein the range of diameters in at least one of the fractions is approximately 3-50 mm.

4. The method of claim 1 wherein the range of diameters in at least one of the fractions is approximately 50-150 mm.

5. The method of claim 1 wherein a first fraction contains gold that is separated from other components in the fraction in a centrifugal concentrator.

6. The method of claim 1 wherein the piece that is redirected from an air blast is transferred to a secondary nugget recovery system to further separate aggregate from pieces containing gold.

7. A system for mining alluvial gold deposits, comprising:
a wash system for washing feed to the system at high pressure;
a separation system for separating the feed into a plurality of separate fractions, each fraction containing solids having a different range of diameters from the solids of at least one other fraction;
a nugget recovery system for processing at least one of the fractions, the nugget recovery system having a sensor for detecting gold in the fraction, wherein when gold is detected in a piece of the fraction, an air blast is targeted and delivered at the piece; and
wherein at least one of the fractions contains gold that is detected on a conveyer using a metal detector, and wherein after the gold in the at least one of the fractions is detected, a feed chute positioned proximate an end of the conveyer is redirected to guide gold from the conveyer to a receiving container.

8. The method of claim 7 wherein the range of diameters in at least one of the fractions is approximately 0-3 mm.

9. The system of claim 7 wherein the range of diameters in at least one of the fractions is approximately 3-50 mm.

10. The system of claim 7 wherein the range of diameters in at least one of the fractions is approximately 50-150 mm.

11. The system of claim 7 wherein a first fraction contains gold that is separated from other components in the fraction in a centrifugal concentrator.

12. The method of claim 1 wherein the piece that is redirected from an air blast is transferred as part of a feed stream to a secondary nugget recovery system to further separate aggregate from pieces containing gold.

13. A process for mining gold deposits, comprising:

washing feed for a system at high pressure;

separating the feed into a plurality of separate fractions, each fraction containing solids having a different range of diameters from the solids of at least one other fraction;

transferring at least one of the fractions to a first nugget recovery system using a conveyor, wherein when a sensor detects gold on the conveyor, an air blast is targeted and delivered at the piece to divert a trajectory of the piece to a receiver; and transferring the contents of the receiver to at least a second nugget recovery system using a conveyor and detecting gold in the contents using a sensor, whereupon a trajectory of a gold piece is diverted by a magnetic field.

14. The process of claim 13 wherein the different ranges of diameters include 0-3 mm, 3-50 mm and 50-150 mm.

15. The process of claim 13 wherein a first fraction contains gold that is separated from other components in the fraction in a centrifugal concentrator.

16. The process of claim 13 wherein at least one of the plurality of separate fractions is transferred on a conveyor belt toward a feed chute, and wherein when gold is detected in the fraction, an orientation of the feed chute is automatically adjusted to direct gold falling from the conveying to a receiver.

* * * * *